US009476292B2

(12) United States Patent
Liu et al.

(10) Patent No.: US 9,476,292 B2
(45) Date of Patent: Oct. 25, 2016

(54) DEEPWATER DRILLING CONDITION BASED MARINE RISER MECHANICAL BEHAVIOR TEST SIMULATION SYSTEM AND TEST METHOD

(71) Applicants: SOUTHWEST PETROLEUM UNIVERSITY, Chengdu (CN); Qingyou Liu, Chengdu (CN); Shouwei Zhou, Chengdu (CN); Liangjie Mao, Chengdu (CN)

(72) Inventors: Qingyou Liu, Chengdu (CN); Shouwei Zhou, Chengdu (CN); Liangjie Mao, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 59 days.

(21) Appl. No.: 14/432,486

(22) PCT Filed: Jan. 6, 2014

(86) PCT No.: PCT/CN2014/070190

§ 371 (c)(1),
(2) Date: Mar. 31, 2015

(87) PCT Pub. No.: WO2015/096201

PCT Pub. Date: Feb. 7, 2015

(65) Prior Publication Data

US 2016/0032704 A1 Feb. 4, 2016

(30) Foreign Application Priority Data

Dec. 25, 2013 (CN) ..... 2013 1 0725402

(51) Int. Cl.

| | |
|---|---|
| ***G01N 17/00*** | (2006.01) |
| ***E21B 44/00*** | (2006.01) |
| ***E21B 17/01*** | (2006.01) |
| ***E21B 41/00*** | (2006.01) |

(52) U.S. Cl.
CPC ..... *E21B 44/00* (2013.01); *E21B 17/01* (2013.01); *E21B 41/0007* (2013.01)

(58) Field of Classification Search
CPC ..... E21B 44/00; E21B 17/01
USPC ..... 73/865.6
See application file for complete search history.

(56) References Cited

U.S. PATENT DOCUMENTS 8,485,250 B1 7/2013 Rose

FOREIGN PATENT DOCUMENTS

CN 102806139 A 7/2012
CN 103292970 A * 9/2013

(Continued)

OTHER PUBLICATIONS

J.R. Chaplin et al., "Laboratory measurements of vortex-induced vibrations of a vertical tension riser in a stepped current", Journal of Fluids and Structures, vol. 21, 2006, pp. 3-24.

(Continued)

*Primary Examiner* — John Fitzgerald
*Assistant Examiner* — Truong Phan
(74) *Attorney, Agent, or Firm* — Gokalp Bayramoglu

(57) ABSTRACT

The present invention discloses a deepwater drilling condition based marine riser mechanical behavior test simulation system. An upper three-component dynamometer, an upper connecting structure, a marine riser, a lower connecting structure and a lower three-component dynamometer are connected between an upper trailer connecting plate and a lower trailer connecting plate in sequence. The invention further discloses a test method. The present invention has the advantages that the mechanical behavior of the marine riser under deepwater drilling condition and marine environment coupling effect can be simulated comprehensively and accurately, and the apparatus can simulate ocean current environment, apply top tension to the marine riser, simulate circulation of internal drilling fluids at different current rates, simulate rotation of the drill stem at different rotational speeds and apply different drill pressures.

3 Claims, 5 Drawing Sheets

(56) References Cited

FOREIGN PATENT DOCUMENTS

| | | | |
|---|---|---|---|
| CN | 103292970 | A | 9/2013 |
| CN | 103321637 | A | 9/2013 |
| CN | 103382832 | A | 11/2013 |

OTHER PUBLICATIONS

A. D. Trim et al., "Experimental investigation of vortex-induced vibration of long marine risers". Journal of Fluids and Structures. vol. 21, 2005, pp. 335-361.

Jianqiao Zhang et al., "Experimental investigation of mass ratio on the vortex induced vibration of flexible risers", The Ocean Engineering, vol. 27 No. 4, 2009, pp. 38-44.

Jianqiao Zhang et al, "Analysis on the Vortex-Induced Vibrations Experimental Results of Flexible Risers", China Offshore Platform, vol. 24 No. 4, 2009, pp. 26-32 and 37.

Haiyan Guo et al., "Experimental Study on Coupled Cross Row and in-Line Vortex-Induced Vibration of Flexible Risers", China Ocean Engineering, vol. 22 No. 1, 2008, pp. 123-129.

Haiyan Guo et al., "Performance Comparisons of Vortex-Induced Vibration Suppression Devices for Top Tensioned Riser", Journal of Ship Mechanics, vol. 15 No. 3, 2011, pp. 238-244.

* cited by examiner

DEEPWATER DRILLING CONDITION BASED MARINE RISER MECHANICAL BEHAVIOR TEST SIMULATION SYSTEM AND TEST METHOD

TECHNICAL FIELD

The present invention relates to the technical field of petroleum engineering deepwater drilling simulation technologies, and in particular, to a deepwater drilling condition based marine riser mechanical behavior test simulation system and test method.

BACKGROUND ART

Marine oil and gas resources have become an important part of the global energy strategy at present, and the deepwater areas will become the main territory for oil and gas resource exploration and development in the future. However, the deepwater areas have extremely adverse environmental condition, which places higher demands on deepwater drilling equipment. In the engineering of mining the marine oil and gas resources, a marine riser is a key device that connects a floor and a subsea wellhead, which needs to bear the coupling effects of the marine environments and drilling conditions, and is prone to such accidents as wear, fatigue fracture and the like. Major economic losses and environmental security problems due to marine riser accidents have been caused for multiple times at home and abroad. The marine riser isolates an oil well from the outside seawater, supports various control pipelines, provides a channel for circulation of drilling fluids, and offers guidance for the drilling work of a drilling rod from the drill floor to the subsea wellhead. Therefore, failure of the marine riser will cause damage to drilling vessel, subsea equipment and oil well to result in great economic losses. In addition, the leakage of the drilling fluids and oil will also cause severe environment contamination.

Meanwhile, with the development of marine drilling towards deepwater and ultra-deepwater and ever-increasing slenderness ratio of the marine riser, the flexible features become more apparent, and the top tensions actually applied at the two ends of the marine riser in the engineering are increased therewith. In addition, the dynamic response of the marine riser to the self vibration thereof causes periodic changes to the axial forces born by the upper and lower boundaries of the marine riser. Therefore, the axial force bearing feature of the marine riser places higher demands on the axial intensity of the marine riser. The huge span of the marine riser on a direction vertical to the sea level makes the transverse modification of the marine riser be increased greatly under the joint action of wind waves and currents. Moreover, such vortex-induced vibration of the marine riser as ocean current, wave, wind load and the like are more important reason of the fatigue failure thereof. The seawater while flowing through the marine water will form alternate shedding vortex at the two sides of the marine riser body, thus inducing the periodic vibration of the marine riser, while the vibration of the marine riser will further disturb shedding of current field vortex. When the shedding frequency of the vortex is approximate to the natural frequency of the marine riser, a locking phenomenon will occur, and the structure of the marine riser resonates largely thus accelerating the fatigue failure of the marine riser.

Presently, studies on marine riser are approximately divided into three broad categories: test method, numerical method and semi-empirical formula. For the test method, the axial force bearing changes, the lateral load and force bearing changes as well as lateral displacement and real time strain changes of the marine riser are complicated and volatile change process. Moreover, the vortex-induced vibration caused by vortex shedding is a multi-physics coupling interacted complicated process. The more prominent for the petroleum engineering deepwater drilling is that: excluding such marine working conditions as wind, wave, current and the like, those drilling conditions as circulation of the drilling fluids in the annular part of the interior of the marine riser and the collision and friction between the rotation of a drill stem and the marine riser also have a great impact on the mechanical behavior of the marine riser. Therefore, a set of complete physical test scheme and precise test instruments that can synchronously observe all related machine models is needed to truly test and study the mechanical property of the marine riser during the actual production process, so as to determine the joint effect thereof. It is usually very difficult for a physical test to provide the instantaneous change data of the fluids at the same time. Therefore, to comprehensively and truly simulate the working condition of the marine riser is the premise for the credibility of the test, and to monitor the instantaneous change of the marine riser and the surrounding current field is the key for the success of the test.

Presently, most studies on the failure of the marine riser at home and abroad focus on the vortex-induced vibration of the marine riser, but neglect that the deepwater drilling process is, an engineering having a shorter period. The fatigue failure doe cause damage to the service life of the marine riser; however, compared with the failure caused by mutations of such load as wind waves and currents, the fatigue failure caused by the vortex-induced vibration of the marine riser has already played second fiddle. Even for the vortex-induced vibration, the studies on the failure of marine riser at home and abroad have carried out vortex-induced vibration tests on the marine risers having different marine working conditions, different slenderness ratios and different materials. The tests on the vortex-induced vibration of the marine riser or riser conducted by most scholars at home and abroad focus the test emphasis on the changes of incoming current types and slenderness ratios as well as span of Reynolds number. For example: Chaplin developed a test on the vortex-induced vibration of a flexible riser under a step current in 2005. Trim et al conducted a test in a Marintek marine towing basin in 2006, obtaining high-quality data under different water current conditions and high mobility response conditions. Zhang Jianqiao from Dalian University of Technology conducted a test on the vortex-induced vibration of a flexible riser at the nonlinear wave tank of the State Key Laboratory of Coastal and Offshore Engineering of Dalian University of Technology in 2009, and the like. However, studies related to the complicated working conditions for the vortex-induced vibration of the marine riser having a big slenderness ratio during the marine drilling process are still insufficient. In 2008, Guo Haiyan on the basis of the original test, optimized the test design, taking the influences of such factors as different tension forces, internal current rates, mass ratios and the like, on the vortex-induced vibration response of the riser into consideration. In 2011, Guo Haiyan further conducted a vortex-induced vibration response test on the riser under the effects of different internal currents, external currents and top tensions in the "Wind-Wave-Flow" Joint Tank of Ocean University of China. The several tests taking the internal current of the riser into consideration cannot simulate the actual working condition of the marine riser in true marine drilling process more comprehensively yet although the simulation about the drilling condition of the marine riser is further improved. Therefore, the studies on the mechanical behavior of the marine riser marine riser are not comprehensive yet.

SUMMARY OF THE INVENTION

The object of the present invention lies in overcoming the defects of the prior art and providing a deepwater drilling condition based marine riser mechanical behavior test simulation system capable of comprehensively and accurately simulating the mechanical behavior of the marine riser under a deepwater drilling condition.

The present invention is embodied by the follow technical solution: A deepwater drilling condition based marine riser mechanical behavior test simulation system, comprising: an upper sliding guide, a lower sliding guide, an upper trailer connecting plate, a lower trailer connecting plate, a top tension applying mechanism, a drill pressure regulating mechanism, a submersible pump, an air compressor, a frequency converter, a servo motor encoder, an internal current flowmeter and a control cabinet, wherein the frequency converter and the servo motor encoder are arranged in a watertight caisson, the upper trailer connecting plate is connected onto the upper sliding guide, the lower trailer connecting plate is connected onto the lower sliding guide, and an upper three-component dynamometer, an upper connecting structure, a marine riser, a lower connecting structure and a lower three-component dynamometer connected in sequence are arranged between the upper trailer connecting plate and the lower trailer connecting plate along a direction from top to bottom;

the upper connecting structure comprises a motor support, a corrugated pipe, an upper tee fitting, an upper bearing cap, a plate A and an upper barb fitting, the lower end of the three-component dynamometer fixedly connected onto the upper trailer connecting plate is connected to the motor support through a connecting piece, a driving device is fixedly mounted on the motor support, an output shaft of the driving device is connected to an upper chucking cutter bar through a coupler, an upper fixed supporting seat is also arranged on the motor support, the upper chucking cutter bar is rotatably mounted in the shaft hole of the upper fixed supporting seat and positioning of the upper chucking cutter bar along the axis direction of the upper fixed supporting seat is realized through a locking screw, the lower end of the upper fixed supporting seat is sequentially connected to the corrugated pipe and the upper tee fitting, the lower end of the upper chucking cutter bar stretches into the corrugated pipe, a dynamic seal structure is arranged between the upper fixed supporting seat and the corrugated pipe, the lower end opening of the upper tee fitting is fixedly connected to the upper bearing cap, the interior of the upper bearing cap is provided with a recess A for containing an upper knuckle bearing, an upper pipe adapter communicated with the recess A is arranged on the upper bearing cap, the upper pipe adapter is connected to the upper tee fitting, the upper knuckle bearing is mounted in the recess A of the upper bearing cap, and is clamped and fixed by the plate A fixedly connected to the upper bearing cap, and the lower end of the upper barb fitting penetrates through the upper knuckle bearing and is fixed through an upper end flange structure;

the top tension applying mechanism comprises a guide block A fixedly connected to the upper trailer connecting plate and a sliding block A driven by a cylinder mechanism A, a vertical sliding rail is arranged on the guide block A, the sliding block A is arranged on the vertical sliding rail in a sliding way and is driven to slide by the cylinder mechanism A, a plate C is fixedly connected onto the sliding block A, two sensors for measuring top tension are fixedly arranged on the plate C, one end of the sensor is fixedly mounted onto the plate C, the other end of the sensor is fixedly mounted onto the upper bearing cap, and the two sensors are symmetric around the axis of the upper barb fitting;

the lower connecting structure comprises a lower fixed supporting seat, a lower tee fitting, a lower bearing cap, a plate B and a lower barb fitting, a lower chucking cutter bar is rotatably mounted in the shaft hole of the lower fixed supporting seat and positioning of the lower chucking cutter bar along the axis direction of the lower fixed supporting seat is realized through a locking screw, the upper end of the lower chucking cutter bar stretches into the lower tee fitting, the lower end opening of the lower tee fitting is provided with a dynamic seal structure, the upper end opening of the lower tee fitting is connected to the lower bearing cap, the interior of the lower bearing cap is provided with a recess B for containing a lower knuckle bearing, a lower pipe adapter communicated with the recess A is arranged on the lower portion of the lower bearing cap, the lower pipe adapter is connected to the lower tee fitting, the lower knuckle bearing is mounted in the recess B of the lower bearing cap, and is clamped and fixed by the plate B fixedly connected to the lower bearing cap, the upper end of the lower barb fitting penetrates through the lower knuckle bearing and is fixedly connected to the upper end of the lower three-component dynamometer through a connecting piece, and the lower end of the lower three-component dynamometer is fixedly connected to the lower trailer connecting plate;

the drill pressure regulating mechanism comprises a guide block B fixedly connected to the lower trailer connecting plate and a gliding block B driven by a cylinder mechanism B, a vertical sliding rail is arranged below the guide block B, the gliding block B is arranged on the vertical sliding rail in a sliding way and is driven to slide by the cylinder mechanism B, and the gliding block B is fixedly connected to the lower fixed supporting seat;

the upper end of the marine riser is connected to the upper barb fitting, the lower end of the marine riser is connected to the lower barb fitting, the drill stem is arranged in the marine riser, the upper end of the drill stem is mounted onto the upper chucking cutter bar, and the lower end of the drill stem is mounted onto the lower chucking cutter bar;

a shunt valve is mounted at the air outlet of the air compressor, the shunt valve is connected to the cylinder mechanism A through a pipeline A, a five-position three-way valve A is mounted on the pipeline A, the shunt valve is connected to the cylinder mechanism B through a pipeline B, and a five-position three-way valve B is mounted on the pipeline B:

the submersible pump is communicated to the third end opening of the lower tee fitting through a water duct, and the third end opening of the upper tee fitting is connected to a turbine flowmeter; and the frequency converter is connected with the submersible pump through a cable, and the servo motor encoder is connected with the driving device through a cable; the frequency converter, the servo motor encoder, the turbine flowmeter the sensors, the five-position three-way valve A and the five-position three-way valve B are all connected with the control cabinet through cables.

The driving device comprises a servo motor and a reducer connected to the servo motor, and the servo motor encoder is connected with the servo motor through a cable.

A test method employing the deepwater drilling condition based marine riser mechanical behavior test simulation system, it comprises the following steps of:

S1, regulating a top tension: a controller regulates an atmospheric pressure conveyed to a cylinder mechanism A of an air compressor through a five-position three-way valve A to drive a sliding block A to move along a vertical sliding rail on a guide block A, and the sliding block A drives an upper bearing cap to move upwards or downwards, the upper end of a marine riser is fixedly connected to the upper bearing cap, the lower end of the marine riser is fixedly connected to a plate B; since the plate B is fixedly connected to a lower trailer connecting plate through a lower three-component dynamometer, the top tension of the marine riser can be regulated through the upward or downward, movement of the bearing cap, the top tension is measured through a sensor and is fed back to a control cabinet in real time, thus implementing pressure regulating on a five-position three-way valve A through the controller so as to apply a top tension needed by the test;

S2, regulating a drill pressure: the controller regulates an atmospheric pressure conveyed to a cylinder mechanism B of the air compressor through a five-position three-way valve B to drive a gliding block B to move along a vertical sliding rail on a guide block B, and the sliding block A drives a lower fixed supporting seat to move upwards or downwards, since the upper end of a drill stem is connected to an upper chucking cutter bar, the upper chucking cutter bar is axially positioned by an upper fixed supporting seat, the axial position of the upper fixed supporting seat is fixed, the lower end of the drill stem is connected to a lower chucking cutter bar, and the lower chucking cutter bar is axially positioned by the lower fixed supporting seat, the upper end of the drill stem is fixed, the lower end of the drill stem is supported by the lower fixed supporting seat, and the drill pressure of the drill stem can be regulated through the upward or downward movement of the lower fixed supporting seat;

S3, regulating the rotational speed of the drill stem: the rotational speed of a servo motor is directly inputted through the control cabinet, and the control cabinet transmits a control signal to a servo motor encoder, so as to control a drive motor of a driving device to work at a set rotational speed, thus regulating the rotational speed of the drill stem; and S4, regulating circulation of drilling fluids: the drilling fluids outputted by a submersible pump enter the interior of the marine riser through a lower tee fitting, flow upwards, and finally flow out from the water outlet of an upper tee fitting, a turbine flowmeter connected to the water outlet of the upper tee fitting measures and feeds back a flow to the control cabinet, and the voltage output frequency of a frequency converter is changed through the control cabinet to control the output flow of the submersible pump in real time, thus implementing the function of controlling the flow of the drilling fluids in real time.

The present invention has the following advantages that: the present invention provides a testing apparatus which can simulate the mechanical behavior of a marine riser under deepwater drilling condition and marine environment coupling effect comprehensively and accurately, and the apparatus can simulate ocean current environment, apply top tension to the marine riser, simulate circulation of internal drilling fluids at different flow rates, simulate rotation of the drill stem at different rotational speeds and apply different drill pressures.

In the steric configuration of the entire testing apparatus, a marine riser model is vertically placed, and an upper mechanism actually represents the boundary conditions of the marine riser in an actual production process, a top tension applied is adjustable, and a lower end is connected to a submersible pump to simulate the circulation of drilling fluids inside the marine riser; moreover, the delivery capacity of the drilling fluids is monitored through the cooperative use of the submersible pump and a frequency converter; a lower mechanism applies an adjustable drill pressure, and the rotational speed of a drill stem can be conveniently regulated through a controller; visual control of the rotational speed of the motor and the delivery capacity of the drilling fluids are implemented; a three-component dynamometer monitors the forces of the marine riser on three directions in real time, and truly represents the connection situations of the marine riser. Winds, waves and currents simulated through a test tank are acted on the testing apparatus, or the overwater and underwater portions of the testing apparatus move synchronously on trailers at the upper end and the lower end of the tank, thus being capable of conducting a test on the mechanical behavior of the marine riser under drilling condition and marine environment coupling effect. The apparatus is stable and reliable, can simulate various drilling parameters in the test tank comprising the density of the drilling fluids, the delivery capacity of the drilling fluids, the rotational speed of the drill stem, the tension, the pull of the drill stem and the mechanical behavior of the marine riser under the effects of the winds, waves and currents as well as combinations thereof.

In the figures, 1—upper slide guide, 2—lower slide guide, 3—upper trailer connecting plate, 4—lower trailer connecting plate, 5—submersible pump, 6—air compressor, 7—frequency converter, 8—servo motor encoder, 9—internal current flowmeter, 10—control cabinet, 11—watertight caisson, 12—upper three-component dynamometer, 13—marine riser, 14—lower three-component dynamometer, 15—motor support, 16—corrugated pipe, 17—upper tee fitting, 18—upper bearing cap, 19—plate A, 20—upper barb fitting, 21—driving device, 22—upper fixed supporting seat, 23—upper chucking cutter bar, 24—dynamic seal structure, 25—recess A, 26—upper pipe adapter, 27—upper knuckle bearing, 28—sliding block A, 29—guide block A, 30—plate C, 31—lower fixed supporting seat, 32—lower tee fitting, 33—lower bearing cap, 34—plate B, 35—lower barb fitting, 36—lower chucking cutter bar, 37—recess B, 38—lower pipe adapter, 39—lower knuckle bearing, 40—gliding block B, 41—guide block B, 42—drill stem, 43—shunt valve, 44—pipeline A, 45—five-position three-way valve A, 46—pipeline B, and 47—five-position three-way valve B.

DETAILED DESCRIPTION OF THE PREFERRED EMBODIMENTS

Figure 1:
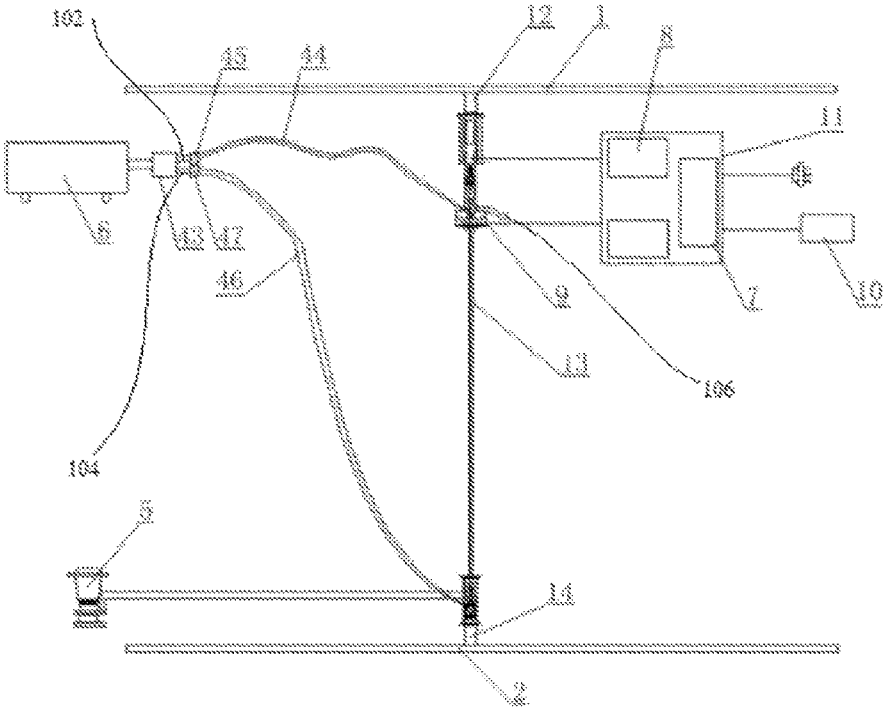
FIG. 1 is a structure schematic view of the present invention.
Figure 2:
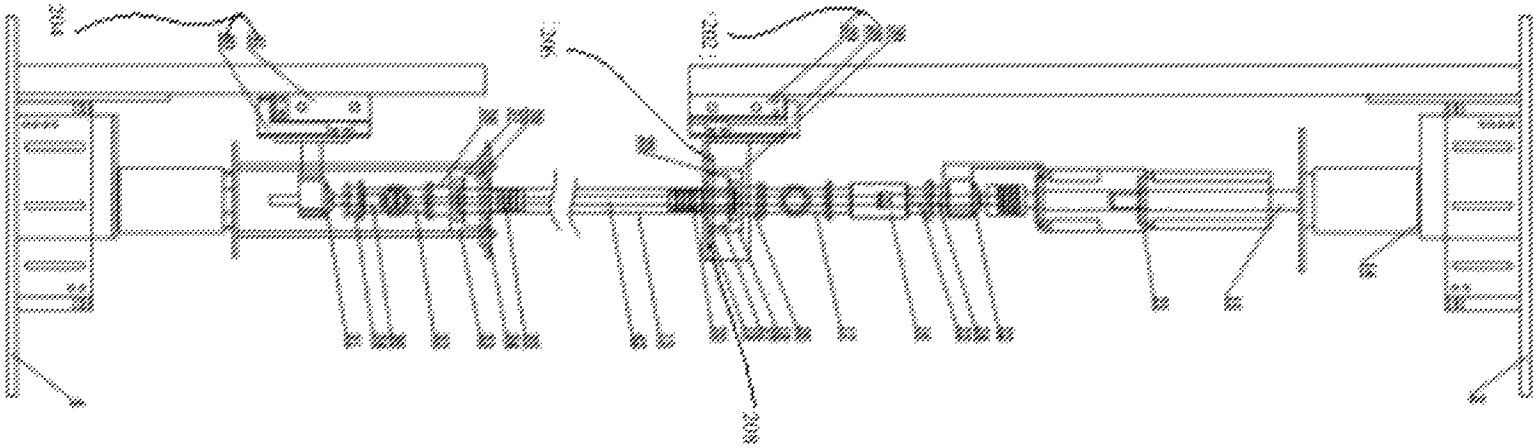
FIG. 2 is a structure schematic view of connection of a marine riser of the present invention.

The present invention will be further described hereinafter by reference to the accompanying drawings; however, the protection scope of the present invention is not limited to the following descriptions. As shown in FIG. 1 and FIG. 2, a deepwater drilling condition based marine riser mechanical behavior test simulation system comprises an upper slide guide 1, a lower sliding guide 2, an upper trailer connecting plate 3, a lower trailer connecting plate 4, a top tension applying mechanism, a drill pressure regulating mechanism, a submersible pump 5, an air compressor 6, a frequency converter 7, a servo motor encoder 8, an internal current flowmeter 9 and a control cabinet 10. The frequency converter 7 and the servo motor encoder 8 are arranged in a watertight caisson 11, the upper trailer connecting plate 3 is fastened and connected onto the upper sliding guide 1 through a bolt, the lower trailer connecting plate 4 is fastened and connected onto the upper slide guide 1 through a bolt; in this way, the upper and lower supports of an entire test bed are formed by the trailer connecting plates and the sliding guides. An upper three-component dynamometer 12, an upper connecting structure, a marine riser 13, a lower connecting structure and a lower three-component dynamometer 14 connected in sequence are arranged between the upper trailer connecting plate 3 and the lower trailer connecting plate 4 along a direction from top to bottom for conveniently measuring the forces born by the marine riser 13 and a drill stem 42 on three directions in space. Both the upper trailer connecting plate 3 and the lower trailer connecting plate 4 are rectangular stainless steel plates. Four through holes are evenly distributed on a circle having a diameter of 36 mm. Through the holes, the upper and lower three-component dynamometers are positioned in a manner of set screw, and are locked on the corresponding trailer connecting plates.

The upper connecting structure comprises a motor support 15, a corrugated pipe 16, an upper tee fitting 17, an upper bearing cap 18, a plate A19 and an upper barb fitting 20. The upper end of the upper three-component dynamometer 12 is fixedly connected to the upper trailer connecting plate 3, and the lower end of the upper three-component dynamometer 12 is connected to the motor support 15 through a connecting piece. A driving device 21 is fixedly mounted on the motor support 15, and an output shaft of the driving device 21 is connected to an upper chucking cutter 23 through a coupler. An upper fixed supporting seat 22 is also arranged on the motor support 15. A shaft hole matched with the upper chucking cutter bar 23 is arranged in the upper fixed supporting seat 22. The upper chucking cutter bar 23 penetrates through the shaft hole of the upper fixed supporting seat 22 and positioning of the upper chucking cutter bar 23 along the axis direction of the upper fixed supporting seat is realized through a locking screw and screw threads processed by the cutter bar. The upper chucking cutter bar 23 is rotatably matched with the shaft hole of the upper fixed supporting seat 22; that is, the outside diameter of the upper chucking cutter bar 23 is equal to the inside diameter of the upper fixed supporting seat 22, and the upper chucking cutter bar can rotate freely in the upper fixed supporting seat 22 along the circumferential direction. The lower end of the upper fixed supporting seat 22 is sequentially connected to the corrugated pipe 16 and the upper tee fitting 17, and the lower end of the upper chucking cutter bar 23 stretches into the corrugated pipe 16. A dynamic seal structure 24 which seals the upper end opening of the corrugated pipe 16 and allows the rotation of the upper chucking cutter bar 23 is arranged between the upper fixed supporting seat 22 and the corrugated pipe 16. The lower end opening of the upper tee fitting 17 is fixedly connected to the upper bearing cap 18, the interior of the upper bearing cap 18 is provided with a recess A25 for containing an upper knuckle bearing 27, an upper pipe adapter 26 communicated with the recess A25 is arranged on the upper bearing cap 18, and the upper pipe adapter 26 is connected to the upper tee fitting 17. The upper knuckle bearing 27 is mounted in the recess A25 of the upper bearing cap 18, and the plate A19 arranged at the lower portion of the bearing is fixedly connected to the upper bearing cap 18. The upper knuckle bearing 27 is clamped and fixed by the upper bearing cap 18 and the plate A19, the lower end of the upper barb fitting 20 penetrates through the upper knuckle bearing 27 and is fixed through an upper end flange structure, and a given-way hole for the upper barb fitting 20 to penetrate out is arranged on the plate A19.

The top tension applying mechanism comprises a guide block A29 fixedly connected to the upper trailer connecting plate 3 and a sliding block A28 driven by a cylinder mechanism A 202. A vertical sliding rail is arranged on the guide block A29, the sliding block A28 is arranged on the vertical sliding rail in a sliding way and is driven to slide by the cylinder mechanism A 202. a plate C30 is fixedly connected onto the sliding block A28, two sensors 206 and 208 for measuring top tension are fixedly arranged on the plate C30, one end of the sensor 206 is fixedly mounted onto the plate C30, the other end of the sensor 206 is fixedly mounted onto the upper bearing cap 18, and the two sensors 206 and 208 are symmetric around the axis of the upper barb fitting 20.

Figure 3:
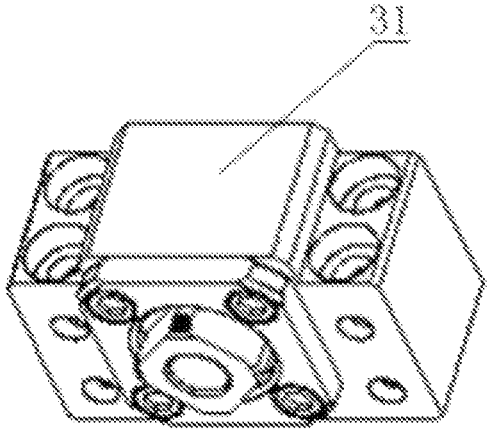
FIG. 3 is a structure schematic view of a lower fixed supporting seat of the present invention.
Figure 4:
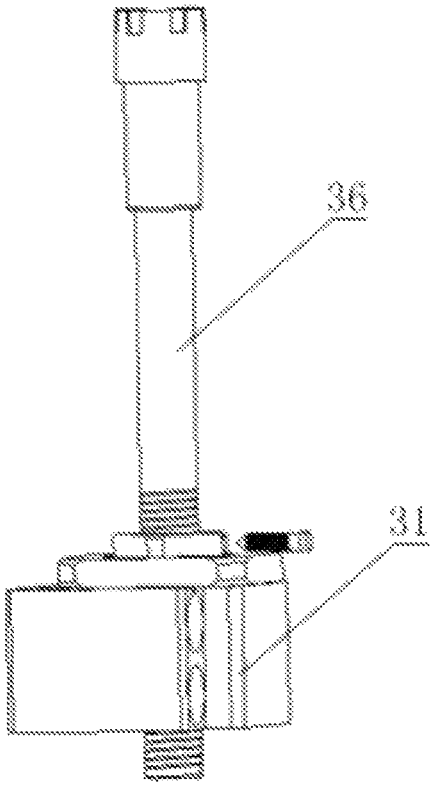
FIG. 4 is a structure schematic view of connection of the lower fixed supporting seat and a lower chucking cutter bar of the present invention.

The lower connecting structure comprises a lower fixed supporting seat 31, a lower tee fitting 32, a lower bearing cap 33, a plate B34 and a lower barb fitting 35. A shaft hole matched with a lower chucking cutter bar 36 is arranged in the lower fixed supporting seat 31. As shown in FIG. 3 and FIG. 4, the lower chucking cutter bar 36 penetrates through the shaft hole of the lower fixed supporting seat 31 and positioning of the lower chucking cutter bar 36 along the axis direction of the lower fixed supporting seat is realized through a locking screw and screw threads processed by the cutter bar. The lower chucking cutter bar 36 is rotatably matched with the shaft hole of the lower fixed supporting seat 31; that is, the outside diameter of the lower chucking cutter bar 36 is equal to the inside diameter of the lower fixed supporting seat 31, and the lower chucking cutter bar can rotate freely in the lower fixed supporting seat 31 along the circumferential direction. The upper end of the lower chucking cutter bar 36 stretches into the lower tee fitting 32, the lower end opening of the lower tee fitting 32 is provided with a dynamic seal structure 24 which seals the lower end opening of the lower tee fitting 32 and allows the rotation of the lower chucking cutter bar 36. The upper end opening of the lower tee fitting 32 is connected to the lower bearing cap 33, the interior of the lower bearing cap 33 is provided with a recess B37 for containing a lower knuckle bearing 39, a lower pipe adapter 38 is arranged on the lower portion of the lower bearing cap 33, and the lower pipe adapter 38 is connected to the lower tee fitting 32. The lower knuckle bearing 39 is mounted in the recess B37 of the lower bearing cap 33, and the plate B34 arranged on the upper portion of the bearing is fixedly connected to the lower bearing cap 33. The lower knuckle bearing 39 is clamped and fixed by the lower bearing cap 33 and the plate B34, the upper end of the lower barb fitting 35 penetrates through the lower knuckle bearing 39 and is fixed through an upper end flange structure, and a given-way hole for the lower barb fitting 35 to penetrate out is arranged on the plate B34. The plate B34 is fixedly connected to the upper end of the lower three-component dynamometer 14 through a connecting piece, and the lower end of the lower three-component dynamometer 14 is fixedly connected to the lower trailer connecting plate 4.

Figure 5:
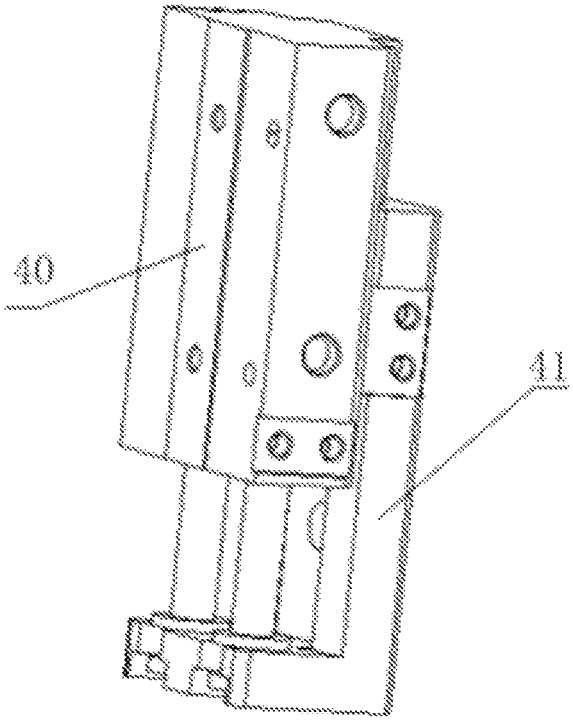
FIG. 5 is a structure schematic view of cooperation of a gliding block B and a guide block B of the present invention.

The drill pressure regulating mechanism comprises a guide block B41 fixedly connected to the lower trailer connecting plate 4 and a gliding block B40 driven by a cylinder mechanism B 204. A vertical sliding rail is arranged below the guide block B41, the gliding block B40 is arranged on the vertical sliding rail in a sliding way and is driven to slide by the cylinder mechanism B 204. As shown in FIG. 5, the gliding block B40 is fixedly connected to the lower fixed supporting seat 31.

The upper end of the marine riser 13 is connected to the upper barb fitting 20, the lower end of the marine riser 13 is connected to the lower barb 35 and fixed by a hoop, the drill stem 42 is arranged in the marine riser 13, the upper end of the drill stem 42 is mounted onto the upper chucking cutter bar 23, and the lower end of the drill stem 42 is mounted onto the lower chucking cutter bar 36. When mounting the drill stem 42, after the drill stem 42 is inserted into a cutter bar core at the end portion of the chucking cutter bar, a cutter bar cap is locked tightly through a knob.

A shunt valve 43 is mounted at the air outlet of the air compressor 6, the shunt valve 43 is connected to the cylinder mechanism A 202 through a pipeline A44, a five-position three-way valve A45 is mounted on the pipeline A44, the shunt valve 43 is connected to the cylinder mechanism B 204 through a pipeline B46, and a five-position three-way valve B47 is mounted on the pipeline B46. After being pressed one portion of pressed gas is connected to the cylinder mechanism A 202 through the five-position three-way valve A45 for applying a top tension, and another portion of the pressed gas is connected to the cylinder mechanism B 204 through the five-position three-way valve B47 for applying a drill pressure.

In order to comprehensively simulate the demands of the drilling condition of the marine riser 13 on the flow rates of the interior fluids, the third end opening of the lower tee fitting 32 is communicated through a water duct, and the connecting part infixed through a hoop. The marine riser 13 itself is taken as an interior flow path for the drilling fluids, waterflow is sucked in from the lower tee fitting 32, passes through the upper barb fitting 20 and discharged through the upper tee fitting 17, and the third end opening of the upper tee fitting 17 is connected to the turbine flowmeter 106.

The frequency converter 7 is connected to the submersible pump 5 through a cable. In order to comprehensively simulate the demands of the drilling condition of the marine riser 13 on the rotational speeds of the interior fluids, the servo motor encoder 8 is connected to the servo motor of the driving device 21 through a cable.

The frequency converter 7, the servo motor encoder 8, the turbine flowmeter 106, the sensors 206 and 208, the five-position three-way valve A45 and the five-position three-way valve B47 are all connected with the control cabinet 10 through cables. The frequency converter 7 and the servo motor encoder 8 are arranged in the watertight caisson 11, and the watertight caisson 11 is connected to the control cabinet 10 through a communication line so as to implement real time visual control of the flow rates of the drilling fluids and the rotational speeds of the drill stem 42.

The upper three-component dynamometer 12 and the lower three-component dynamometer 14 are respectively used for measuring the forces born by the drill stem 42 and the marine riser 13 on three directions in space.

The trailer connecting plates are connected onto the sliding guides. The upper trailer connecting plate 3 and the lower trailer connecting plate 4 are synchronously driven by the servo motor to slide along the sliding guides, which can accurately simulate the flow rate of an ocean current.

The driving device 21 comprises the servo motor and a reducer connected to the servo motor.

The motor support 15 comprises an upper contact plate, a lower contact plate and a connecting part connecting the upper contact plate and the lower contact plate, approximating to a "]" shape. The upper contact plate is fixedly connected to the connecting plate fixedly arranged on the lower end face of the upper three-component dynamometer 12. The upper contact plate is provided with a through hole and the aperture of the hole is the spigot diameter of the reducer. The servo motor after being connected to the reducer is connected onto the upper contact plate through a bolt. The contact surface of the upper contact plate and the reducer is provided with a hole. The output shaft of the reducer is connected to the coupler through the hole. The other end of the coupler is connected to the upper chucking cutter bar 23. The face of the lower contact plate parallel to the vertical face is connected to the fixed supporting seat to ensure excellent verticality and concentration of the drill stem 42.

Both the interior of the upper bearing cap 18 and the interior of the lower bearing cap 33 are designed with two-stage steps. The recess formed by the first-stage step is used for the plate to conduct axial positioning on a centripetal knuckle bearing. The inside diameter of the bearing cap is in interference fit with the centripetal knuckle bearing to conduct circumferential positioning on the bearing and ensures the leak tightness at the same time. The recess formed by the second-stage step is used for providing a space condition for the barb fitting penetrating the bearing to rotate around the bearing during the test. The barb fitting penetrates through the inside diameter of the knuckle bearing and is positioned through a self flange structure. The bearing cap and the plate are connected through a bolt and are preferably sealed through an O ring in the bearing cap. The plate A19 and the plate B34 are rectangle aluminum plates having a thick of 5 mm, provided with a bolt hole, and also provided with a through hole for the barb fitting to pass through. The flange structure at the top end of the bearing cap is connected to the tee fitting at the corresponding side in a manner of hoop. The upper tee fitting 17 is connected to the corrugated pipe 16 and the dynamic seal structure 24 similarly in a manner of hoop for ensuring the tightness of the entire drilling fluids circulation path.

The submersible pump 5 is a 220V single-phase submersible pump 5. When in use, the starting capacitance of the pump is removed, and the output terminals w, u and v of the frequency converter 7 are directly connected to the three wires of a wire connecting box of the pump. The object of changing the delivery capacity of the drilling fluids can be achieved by changing the frequency of the frequency converter 7 for outputting three-phase 220V currents.

A test method employing a deepwater drilling condition based marine riser mechanical behavior test simulation system comprises the following steps of S1, regulating a top tension: a controller 102 regulates an atmospheric pressure conveyed to a cylinder mechanism A 202 of an air compressor 6 through a five-position three-way valve A45 to drive a sliding block A28 to move along a vertical sliding rail on a guide block A29, and the sliding block A28 drives an upper bearing cap 18 to move upwards or downwards, the upper end of a marine riser 13 is fixedly connected to the upper bearing cap 18, the lower end of the marine riser 13 is fixedly connected to a plate B34; since the plate B34 is fixedly connected to a lower trailer connecting plate 4 through a lower three-component dynamometer 14, so that the lower portion of the marine riser 13 is fastened and chucked, and the upper portion of the marine riser bears a pulling force to realize application of the top tension of the marine riser 13, and the top tension of the marine riser 13 can be regulated through the upward or downward movement of the bearing cap, the top tension is measured through a sensor 206/208 and is fed back to a control cabinet 10 in real time, thus implementing pressure regulating on a five-position three-way valve A45 through the controller 102 so as to apply a top tension needed by the test; the top tension is increased when the sliding block A28 vertically moves upwards and decreased when the gliding block B40 vertically moves downwards;

S2, regulating a drill pressure: a controller 104 regulates an atmospheric pressure conveyed to a cylinder mechanism B 204 of the air compressor 6 through a five-position three-way valve B47 to drive the gliding block B40 to move along a vertical sliding rail on a guide block B41, and the sliding block A28 drives a lower fixed supporting seat 31 to move upwards or downwards, since the upper end of a drill stem 42 is connected to an upper chucking cutter bar 23, the upper chucking cutter bar 23 is axially positioned by an upper fixed supporting seat 22, the axial position of the upper fixed supporting seat 22 is fixed, the lower end of the drill stem 42 is connected to a lower chucking cutter bar 36, and the lower chucking cutter bar 36 is axially positioned by the lower fixed supporting seat 31, the upper end of the drill stem 42 is fixed, the lower end of the drill stem is supported by the lower fixed supporting seat 31, and the drill pressure of the drill stem 42 can be regulated through the upward or downward movement of the lower fixed supporting seat 31;

S3, regulating the rotational speed of the drill stem 42: the rotational speed of a servo motor is directly inputted through the control cabinet 10, and the control cabinet 10 transmits a control signal to a servo motor encoder 8, so as to control a drive motor of a driving device 21 to work at a set rotational speed, thus regulating the rotational speed of the drill stem 42;

S4, regulating circulation of drilling fluids: the drilling fluids outputted by a submersible pump 5 enter the interior of the marine riser 13 through a lower tee fitting, flow upwards, and finally flow out from the water outlet of an upper tee fitting, a turbine flowmeter 106 connected to the water outlet of the upper tee fitting 17 measures and feeds back a flow to the control cabinet 10, and the voltage output frequency of a frequency converter 7 is changed through the control cabinet 10 to control the output flow of the submersible pump 5 in real time, thus implementing the function of controlling the flow of the drilling fluids in real time; the drilling fluids pass through the submersible pump 5, a lower tee fitting 32, a lower bearing cap 33, a lower barb fitting 35, the marine riser 13, an upper barb fitting 20, the upper bearing cap 18, and the upper tee fitting 17 in sequence from bottom to top, thus forming a drilling fluids circulation path; and the sealing of a drilling fluids loop is implemented through an upper dynamic seal structure 24 and a lower dynamic seal structure 24.

The invention claimed is:

1. A deepwater drilling condition based marine riser mechanical behavior test simulation system, comprising:

an upper sliding guide, a lower sliding guide, an upper trailer connecting plate, a lower trailer connecting plate, a top tension applying mechanism, a drill pressure regulating mechanism, a submersible pump, an air compressor, a frequency converter, a servo motor encoder, an internal current flowmeter and a control cabinet;

wherein the frequency converter and the servo motor encoder are arranged in a watertight caisson;

wherein the upper trailer connecting plate is connected onto the upper sliding guide;

wherein the lower trailer connecting plate is connected onto the lower sliding guide;

wherein an upper three-component dynamometer, an upper connecting structure, a marine riser, a lower connecting structure and a lower three-component dynamometer connected in sequence are arranged between the upper trailer connecting plate and the lower trailer connecting plate along a direction from top to bottom;

wherein the upper connecting structure further comprises a motor support, a corrugated pipe, an upper tee fitting, an upper bearing cap, a first plate and an upper barb fitting;

wherein a lower end of the three-component dynamometer fixedly connected onto the upper trailer connecting plate is connected to the motor support through a connecting piece;

wherein a driving device is fixedly mounted on the motor support:

wherein an output shaft of the driving device is connected to an upper chucking cutter bar through a coupler;

wherein an upper fixed supporting seat is also arranged on the motor support;

wherein the upper chucking cutter bar is rotatably mounted in the shaft hole of the upper fixed supporting seat and positioning of the upper chucking cutter bar along the axis direction of the upper fixed supporting seat is realized through a locking screw;

wherein the lower end of the upper fixed supporting seat is sequentially connected to the corrugated pipe and the upper tee fitting;

wherein the lower end of the upper chucking cutter bar stretches into the corrugated pipe;

wherein a dynamic seal structure is arranged between the upper fixed supporting seat and the corrugated pipe;

wherein a lower end opening of the upper tee fitting is fixedly connected to the upper bearing cap;

wherein a interior of the upper bearing cap is provided with a first recess for containing an upper knuckle bearing;

wherein an upper pipe adapter communicated with the first recess is arranged on the upper bearing cap, and the upper pipe adapter is connected to the upper tee fitting;

wherein the upper knuckle bearing is mounted in the first recess of the upper bearing cap, and is clamped and fixed by the first plate fixedly connected to the upper bearing cap;

wherein a lower end of the upper barb fitting penetrates through the upper knuckle bearing and is fixed through an upper end flange structure;

wherein the top tension applying mechanism further comprises a first guide block fixedly connected to the upper trailer connecting plate and a first sliding block driven by a first cylinder mechanism;

wherein a vertical sliding rail is arranged on the first guide block;

wherein the first sliding block is arranged on the vertical sliding rail in a sliding way and is driven to slide by the first cylinder mechanism;

wherein a third plate is fixedly connected onto the first sliding block;

wherein two sensors for measuring top tension are fixedly arranged on the third plate, first sensor is fixedly mounted onto the third plate, second sensor is fixedly mounted onto the upper bearing cap;

wherein the two sensors are symmetric around the axis of the upper barb fitting;

wherein the lower connecting structure comprises a lower fixed supporting seat, a lower tee fitting, a lower bearing cap, a second plate and a lower barb fitting;

wherein a lower chucking cutter bar is rotatably mounted in the shaft hole of the lower fixed supporting seat and positioning of the lower chucking cutter bar along the axis direction of the lower fixed supporting seat is realized through a locking screw;

wherein an upper end of the lower chucking cutter bar stretches into the lower tee fitting, the lower end opening of the lower tee fitting is provided with a dynamic seal structure;

wherein an upper end opening of the lower tee fitting is connected to the lower bearing cap;

wherein an interior of the lower bearing cap is provided with a second recess for containing a lower knuckle bearing;

wherein a lower pipe adapter communicated with the first recess is arranged on the lower portion of the lower bearing cap and the lower pipe adapter is connected to the lower tee fitting;

wherein the lower knuckle bearing is mounted in the second recess of the lower bearing cap, and is clamped and fixed by the second plate fixedly connected to the lower bearing cap;

wherein an upper end of the lower barb fitting penetrates through the lower knuckle bearing and is fixedly connected to an upper end of the lower three-component dynamometer through a connecting piece;

wherein the lower end of the lower three-component dynamometer is fixedly connected to the lower trailer connecting plate, wherein the drill pressure regulating mechanism further comprises a second guide block fixedly connected to the lower trailer connecting plate and a second sliding block driven by a second cylinder mechanism;

wherein a vertical sliding rail is arranged below the second guide block;

wherein the second sliding block is arranged on the vertical sliding rail in a sliding way and is driven to slide by the second cylinder mechanism, and the second sliding block is fixedly connected to the lower fixed supporting seat;

wherein an upper end of the marine riser is connected to the upper barb fitting; a lower end of the marine riser is connected to the lower barb fitting;

wherein a drill stem is arranged in the marine riser;

wherein an upper end of the drill stem is mounted onto the upper chucking cutter bar, and a lower end of the drill stem is mounted onto the lower chucking cutter bar;

wherein a shunt valve is mounted at an air outlet of the air compressor and the shunt valve is connected to the first cylinder mechanism through a first pipeline;

wherein a first five-position three-way valve is mounted on the first pipeline;

wherein the shunt valve is connected to the second cylinder mechanism through a second pipeline;

wherein a second five-position three-way valve is mounted on the second pipeline;

wherein the submersible pump is communicated to a third end opening of the lower tee fitting through a water duct;

wherein a third end opening of the upper tee fitting is connected to a turbine flowmeter;

wherein the frequency converter is connected with the submersible pump through a first cable;

wherein the servo motor encoder is connected with the driving device through a second cable;

wherein the frequency converter, the servo motor encoder, the turbine flowmeter, the sensors, the first five-position three-way valve and the second five-position three-way valve are all connected with the control cabinet through cables.

2. The deepwater drilling condition based marine riser mechanical behavior test simulation system according to claim 1, wherein the driving device further comprises the servo motor and a reducer connected to the servo motor, and the servo motor encoder is connected with the servo motor through a third cable.

3. A test method employing the deepwater drilling condition based marine riser mechanical behavior test simulation system according to claim 1, comprising the following steps of:

regulating a top tension: wherein a controller regulates an atmospheric pressure conveyed to the first cylinder mechanism of the air compressor through the first five-position three-way valve to drive the first sliding block to move along the vertical sliding rail on the first guide block; wherein the first sliding block drives the upper bearing cap to move upwards or downwards; wherein the upper end of the marine riser is fixedly connected to the upper bearing cap, the lower end of the marine riser is fixedly connected to the second plate; wherein since the second plate is fixedly connected to the lower trailer connecting plate through the lower three-component dynamometer the top tension of the marine riser is regulated through the upward or downward movement of the bearing cap, the top tension is measured through a sensor and is fed back to a control cabinet in real time, thus pressure regulating on the first five-position three-way valve is implemented through the controller so as to apply a top tension needed by the test;

regulating a drill pressure: wherein the controller regulates an atmospheric pressure conveyed to a second cylinder mechanism of the air compressor through a second five-position three-way valve to drive the second sliding block to move along a vertical sliding rail on the second guide block; wherein the first sliding block drives the lower fixed supporting seat to move upwards or downwards; wherein the upper end of the drill stem is connected to the upper chucking cutter bar; wherein the upper chucking cutter bar is axially positioned by the upper fixed supporting seat; wherein the axial position of the upper fixed supporting seat is fixed; wherein the lower end of the drill stein is connected to the lower chucking cutter bar, and the lower chucking cutter bar is axially positioned by the lower fixed supporting seat; wherein the upper end of the drill stem is fixed, the lower end of the drill stem is supported by the lower fixed supporting seat; wherein the drill pressure of the drill stem is regulated through the upward or downward movement of the lower fixed supporting seat;

regulating the rotational speed of the drill stem: wherein the rotational speed of the servo motor is directly inputted through the control cabinet, and the control cabinet transmits a control signal to the servo motor encoder, so as to control a drive motor of the driving device to work at a set rotational speed, and to regulate the rotational speed of the drill stem;

regulating circulation of drilling fluids: wherein the drilling fluids outputted by the submersible pump enter the interior of the marine riser through the lower tee fitting, flow upwards, and finally flow out from the water outlet of the upper tee fitting; wherein a turbine flowmeter connected to the water outlet of the upper tee fitting measures and feeds back a flow to the control cabinet; wherein the voltage output frequency of the frequency converter is changed through the control cabinet to control the output flow of the submersible pump in real time, thus implementing the function of controlling the flow of the drilling fluids in real time.

* * * * *